US008973756B2

(12) United States Patent
Liao

(10) Patent No.: US 8,973,756 B2
(45) Date of Patent: Mar. 10, 2015

(54) CORNER SLEEVE WITH HAMMOCK-LIKE CUSHIONING STRUCTURE

(71) Applicant: Yaw-Shin Liao, Taipei (TW)

(72) Inventor: Yaw-Shin Liao, Taipei (TW)

( * ) Notice: Subject to any disclaimer, the term of this patent is extended or adjusted under 35 U.S.C. 154(b) by 0 days.

(21) Appl. No.: 13/947,120

(22) Filed: Jul. 22, 2013

(65) Prior Publication Data

US 2014/0262914 A1 Sep. 18, 2014

(30) Foreign Application Priority Data

Mar. 12, 2013 (TW) ..... 102108584 A

(51) Int. Cl.
*B65D 81/03* (2006.01)
*B65D 81/02* (2006.01)
*B65D 81/05* (2006.01)

(52) U.S. Cl.
CPC ..... *B65D 81/022* (2013.01); *B65D 81/052* (2013.01); *B65D 81/057* (2013.01)
USPC ..... 206/522; 206/453; 206/586; 206/583; 206/454

(58) Field of Classification Search
CPC ..... B65D 81/053–81/058; B65D 81/02; B65D 81/05; B65D 81/07; B65D 81/075; B65D 5/5033; B65D 65/44; B31D 5/0073; F16F 9/0418; A45C 13/021
USPC ..... 206/521, 522, 453, 586, 449, 583, 454, 206/591; 401/41; 150/158; 248/345.1
See application file for complete search history.

(56) References Cited

U.S. PATENT DOCUMENTS

| | | | | |
|---|---|---|---|---|
| 6,202,848 | B1 * | 3/2001 | Tindoll et al. | 206/522 |
| 7,000,767 | B2 * | 2/2006 | Tanaka et al. | 206/522 |
| 7,631,762 | B2 * | 12/2009 | Liao et al. | 206/522 |
| 2008/0197041 | A1 * | 8/2008 | Jian | 206/522 |
| 2011/0271640 | A1 * | 11/2011 | Sperry et al. | 53/79 |
| 2013/0171384 | A1 * | 7/2013 | Liao | 428/35.2 |

* cited by examiner

*Primary Examiner* — Anthony Stashick
*Assistant Examiner* — Mollie Llewellyn

(57) ABSTRACT

A corner sleeve with a hammock-like cushioning structure includes first and second air-column sides and a bottom air-column side. The inner surfaces of the first and second air-column sides are bonded together at a lateral end, except in the vicinity of the bottom air-column side, such that a deformable opening is formed at an end corner of the corner sleeve by the unbonded parts of the inner surfaces of the first and second air-column sides at the lateral end. The air columns of the three air-column sides that form the deformable opening define a cushioning side at the end corner of the corner sleeve. A hammock-like enclosing film extends between the first and second air-column sides without contact with the bottom air-column side. An end corner of an object to be packed can be wrapped between the first, second, and bottom air-column sides and the cushioning side for enhanced protection.

8 Claims, 9 Drawing Sheets

CORNER SLEEVE WITH HAMMOCK-LIKE CUSHIONING STRUCTURE

BACKGROUND OF THE INVENTION

1. Technical Field

The present invention relates to a corner sleeve with a hammock-like cushioning structure. More particularly, the present invention relates to an open-ended cushioning structure pre-formed at a bent end corner of an air-column corner sleeve, the present invention involving an enclosing film which is provided at the bent end corner of the corner sleeve and in which an object to be packed can be supported as in a hammock.

2. Description of Related Art

Liquid crystal display televisions (LCD TVs) and like objects which must be properly packed for shipment have increased so much in size that they cause inconveniences in handling and installation. Therefore, even if they are packed, such objects are subject to wear or damage, especially at the corners, should they be impacted during transportation. In view of this, sleeve-like air-column bags were developed which can be mounted around the end corners of an object to be packed, such as an LCD TV, so as for the inflated air columns to enclose the end corners for cushioning.

However, as the air columns have a bent configuration corresponding in position to the edges of an end corner of an object to be packed, the bent portions of the air columns can easily break. In addition, the air columns of the aforesaid air-column bags or sleeves, which are generally made of polyethylene (PE), are likely to be punctured by the sharp end corners of the objects to be packed, and once punctured, the air columns will leak and eventually lose their cushioning effect.

Moreover, after an object to be packed is placed in an air-column bag, the gap between the bottom of the object and the inner wall of the bottom of the air-column bag will be reduced, if not closed, due to the weight of the object. Hence, if the bottom of the air-column bag hits the ground, there will be insufficient cushioning space, if at all, between the bottom of the object and the inner wall of the bottom of the air-column bag. The impact force generated by the bottom of the air-column bag hitting the ground will be transmitted directly to the bottom of the packed object and cause damage to the object.

BRIEF SUMMARY OF THE INVENTION

The primary object of the present invention is to provide an open-ended cushioning structure pre-formed at a bent end corner of an air-column corner sleeve, with a view to overcoming the aforesaid drawbacks of the prior art air column designs, namely susceptibility to breakage at the bent portions, potential loss of the intended cushioning effect when punctured by a sharp end corner of the packed object, and possible failure to protect the packed object from an impact force generated by collision with the ground, for the impact force may act directly on the bottom of the packed object and thus damage the packed object.

To achieve the aforesaid object, the present invention provides a corner sleeve having a hammock-like cushioning structure, wherein the corner sleeve includes a first air-column side, a second air-column side, and a bottom air-column side connected between bottom portions of the first and the second air-column sides. The first air-column side, the second air-column side, and the bottom air-column side are each provided with a plurality of air columns. Moreover, the first air-column side, the second air-column side, and the bottom air-column side jointly form a receiving space therebetween. The corner sleeve is characterized by the following:

The inner surface of the first air-column side and the inner surface of the second air-column side are bonded together at a first lateral end via one or more fixedly connected portions, except in the vicinity of the bottom air-column side. Consequently, a deformable opening is formed at an end corner of the corner sleeve by an air column of the first air-column side at the first lateral end, an air column of the second air-column side at the first lateral end, and an air column of the bottom air-column side at the first lateral end, wherein the deformable opening corresponds in position to the unbonded parts of the inner surfaces of the first and the second air-column sides at the first lateral end. The air columns forming the deformable opening surround the deformable opening and define a cushioning side at the end corner of the corner sleeve. In addition, a hammock-like enclosing film is provided in the receiving space, extends between the first air-column side and the second air-column side, and stays clear of the bottom air-column side.

Thus, when the first air-column side, the second air-column side, and the bottom air-column side of the corner sleeve are mounted around an end corner of an object to be packed, the deformable opening and the cushioning side of the corner sleeve are located at the end corner of the object, with the cushioning side covering the end corner of the object to provide a cushioning effect. In the meantime, the end corner of the object is wrapped in the enclosing film, supported or held in the receiving space, and kept from contact with the bottom air-column side. As a result, a cushioning distance is formed between the end corner of the object and the bottom air-column side. The cushioning distance and the air columns provide double cushioning.

The present invention further has the following features:

In addition to the foregoing primary structural features, a lateral opening is formed between the first air-column side and the second air-column side at a second lateral end and is in communication with the receiving space and an accommodating space formed by the enclosing film. Also, an upper opening is formed between a top portion of the first air-column side and a top portion of the second air-column side and is in communication with the receiving space, the accommodating space of the enclosing film, and the lateral opening. An object to be packed can be put into the receiving space and the accommodating space of the enclosing film through the lateral opening and the upper opening so as to be wrapped between the first air-column side, the second air-column side, the bottom air-column side, and the cushioning side. Not only that, the object will be wrapped in the enclosing film and thus supported or held in the receiving space without contact with the bottom air-column side.

In addition to the foregoing primary structural features, the one or more fixedly connected portions do not extend to the bottom air-column side, and a predetermined non-heat seal distance is thus formed between the one or more fixedly connected portions and the bottom air-column side. Because of this predetermined distance, the end corner of the corner sleeve forms the deformable opening, which has a triangular shape.

In addition to the foregoing primary structural features, the air columns of the first air-column side may extend to the top portion and the bottom portion of the first air-column side, the air columns of the second air-column side may extend to the top portion and the bottom portion of the second air-column side, and the air columns of the bottom air-column side may extend to two opposite middle sides of the bottom air-column side.

In addition to the foregoing primary structural features, plural air columns of the first air-column side and plural air columns of the second air-column side are respectively in communication with two opposite ends of a single air column of the bottom air-column side.

In addition to the foregoing primary structural features, the one or more fixedly connected portions may be heat-sealed points or heat-sealed lines.

In addition to the foregoing primary structural features, the one or more fixedly connected portions are formed, by heat sealing, on an air column of the first air-column side and an air column of the second air-column side.

In addition to the foregoing primary structural features, the first air-column side has at least one air column which lies between the first lateral end and the one or more fixedly connected portions and which is free of any fixedly connected portion, and the second air-column side has at least one air column which lies between the first lateral end and the one or more fixedly connected portions and which is free of any fixedly connected portion. The air columns free of any fixedly connected portion have larger volumes than those formed with the one or more fixedly connected portions. The end corner of the corner sleeve features enhanced elasticity thanks to the air columns free of any fixedly connected portion and the air columns formed with the one or more fixedly connected portions.

In addition to the foregoing primary structural features, the enclosing film is in the form of a hammock because it has two ends respectively provided at the top portion of the first air-column side and the top portion of the second air-column side and extends to a position adjacent to the bottom air-column side.

In addition to the foregoing primary structural features, the top portion of the first air-column side and/or the top portion of the second air-column side is provided with at least one extension air-column side which can be wrapped around the corner sleeve. Each extension air-column side is provided with a plurality of air columns.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
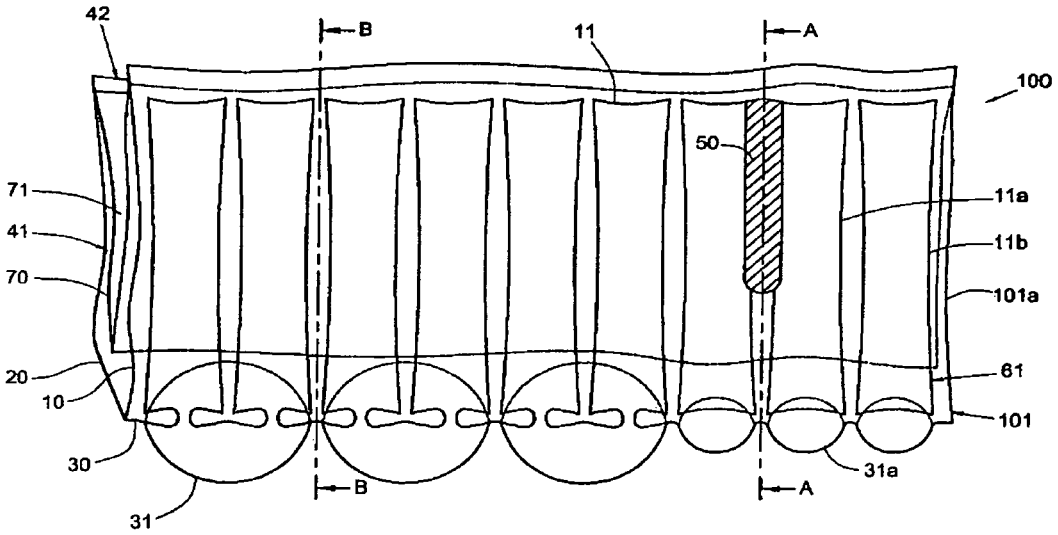
FIG. 1 is a front view of a preferred embodiment of the present invention.
Figure 2:
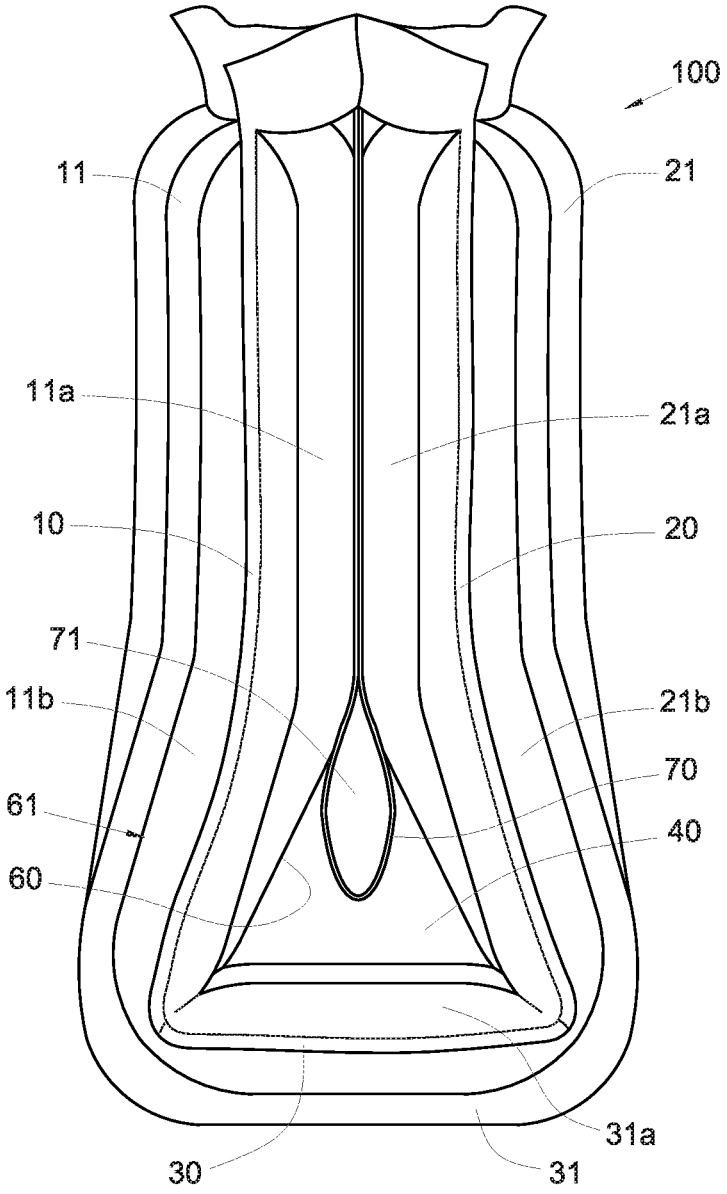
FIG. 2 is a side view of the embodiment shown in FIG. 1.
Figure 3:
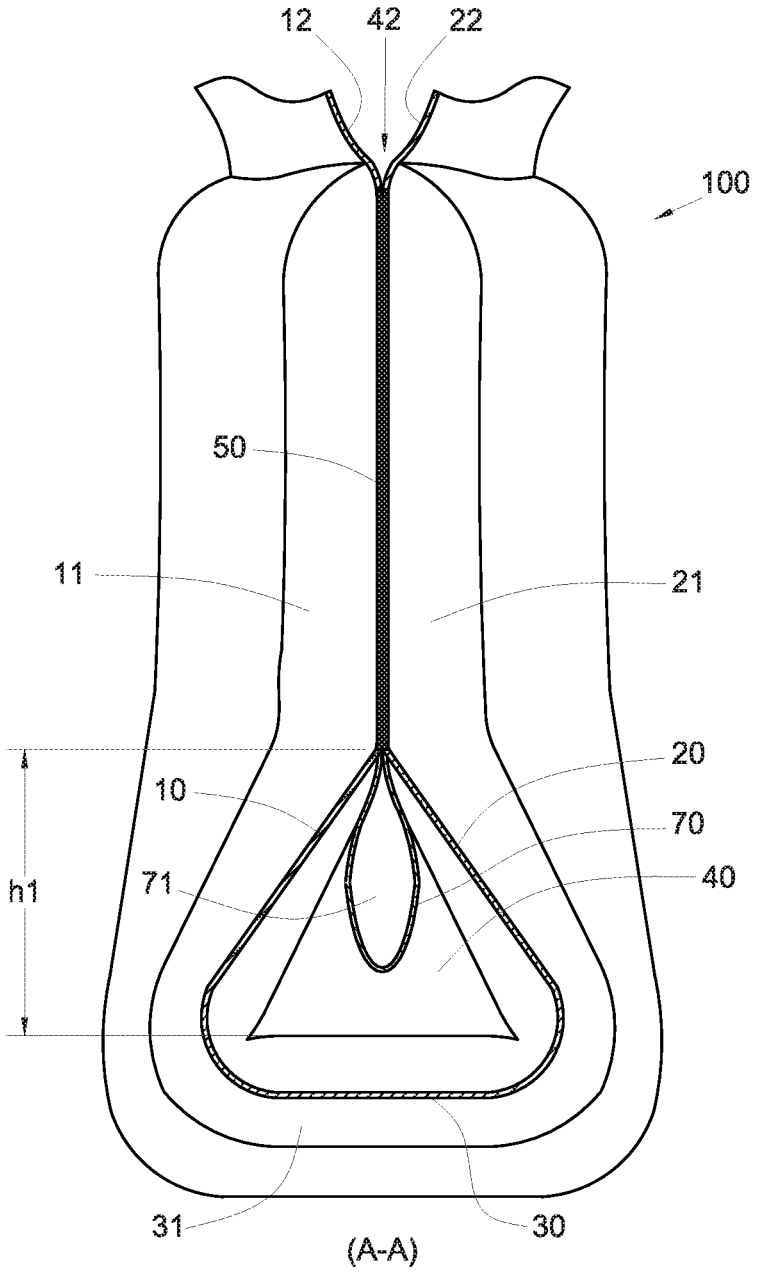
FIG. 3 is a sectional view taken along line A-A of FIG. 1.
Figure 4:
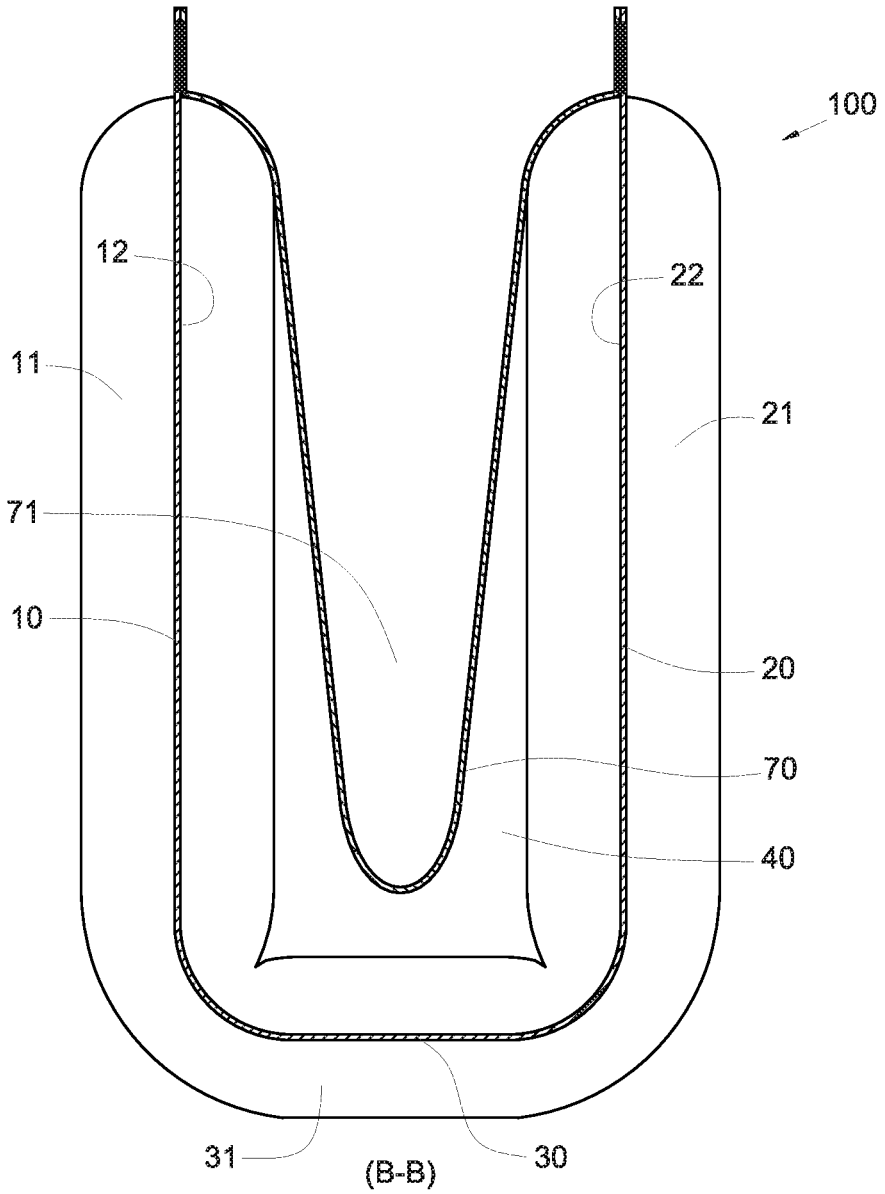
FIG. 4 is a sectional view taken along line B-B of FIG. 1.
Figure 5:
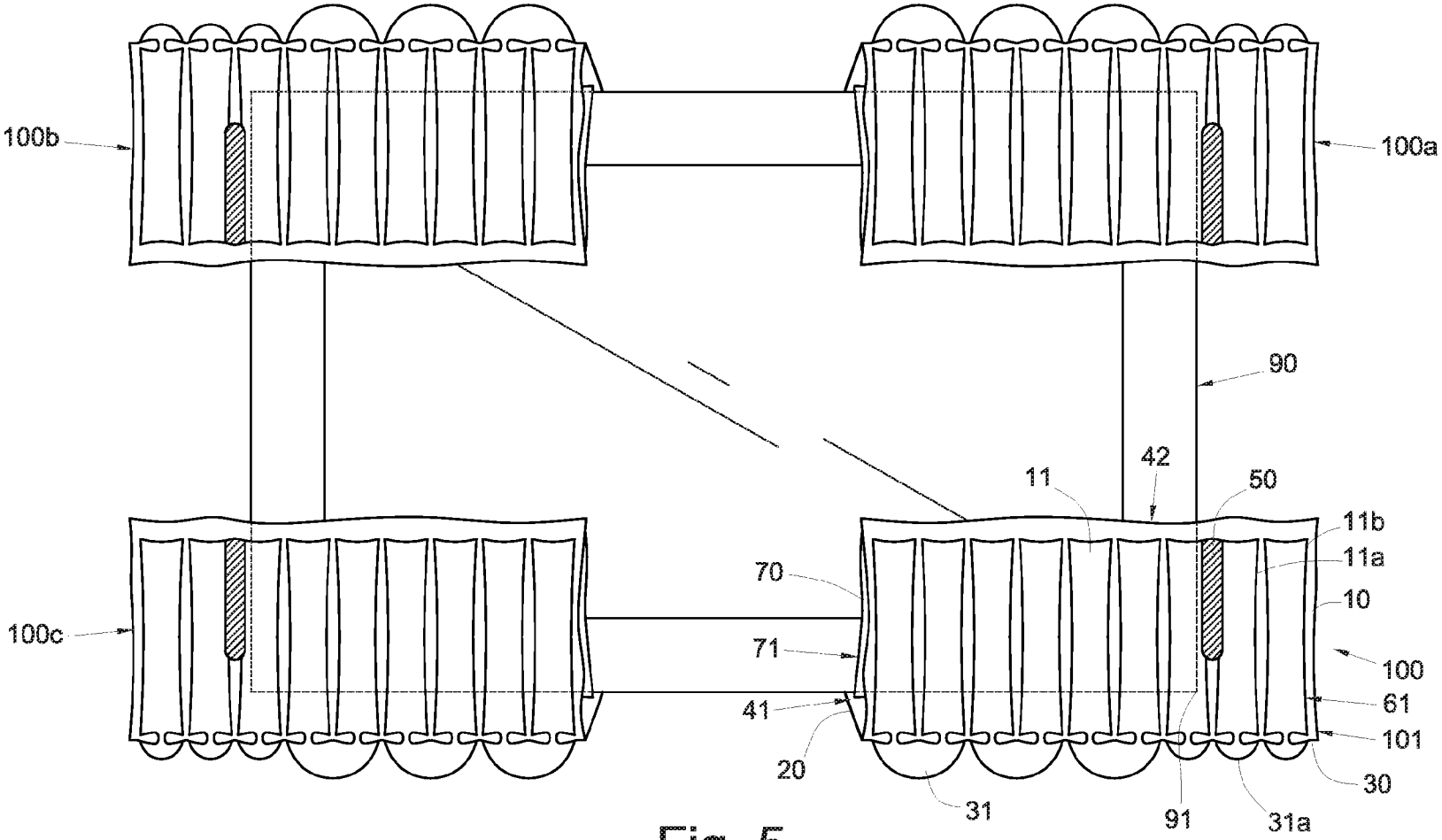
FIG. 5 illustrates how the embodiment shown in FIG. 1 is used.
Figure 6:
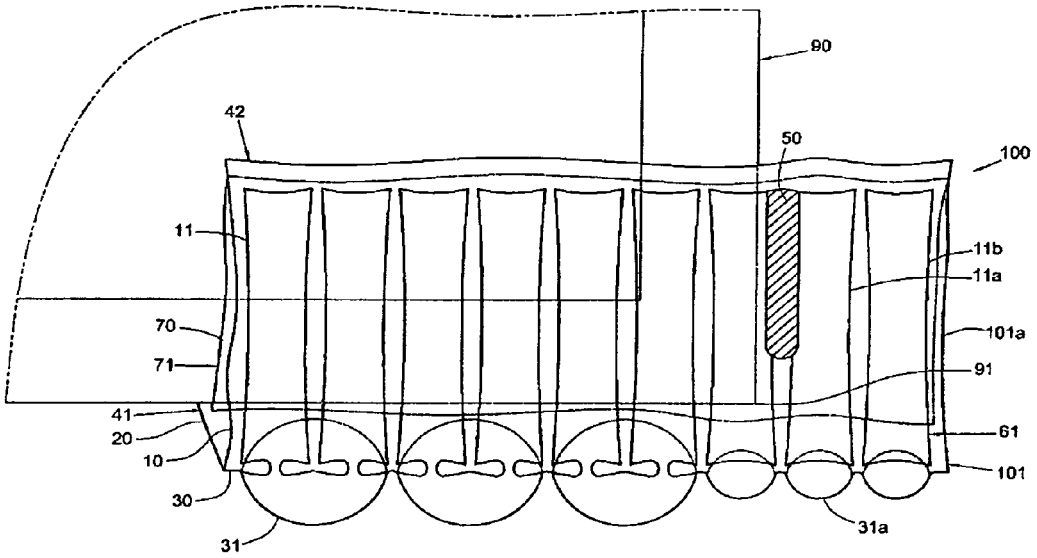
FIG. 6 is a partial enlarged view of FIG. 5.
Figure 7:
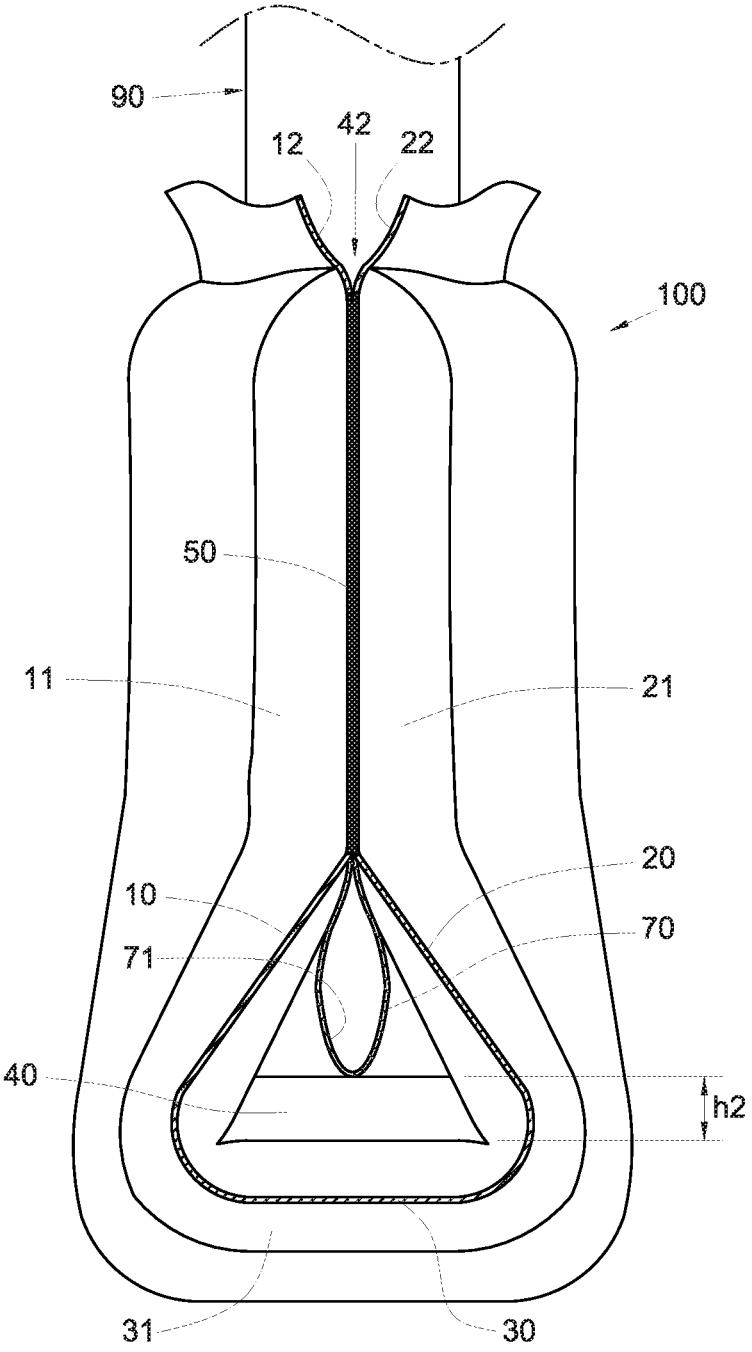
FIG. 7 is a sectional view similar to FIG. 3, showing a state of use.
Figure 8:
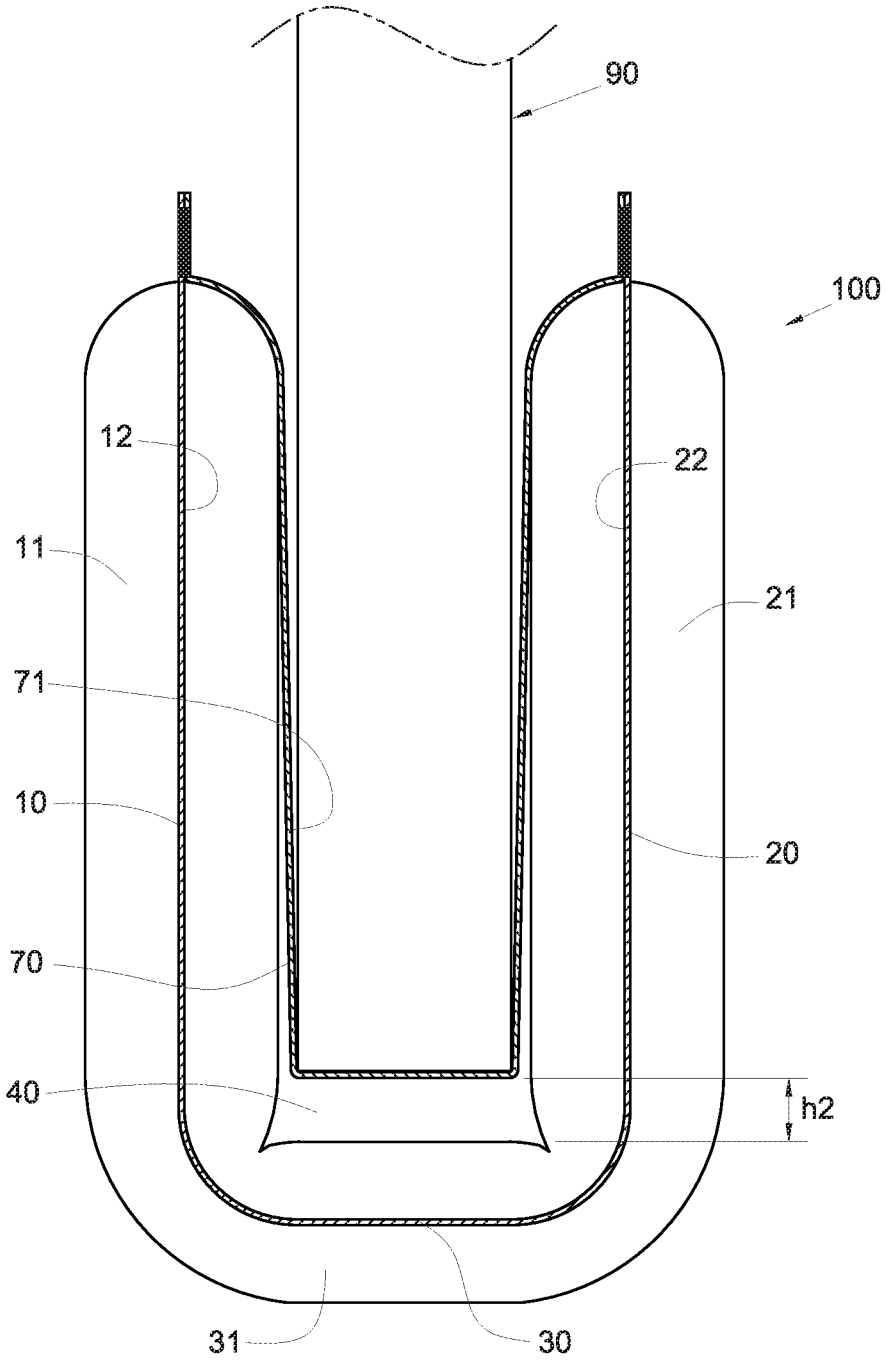
FIG. 8 is a sectional view similar to FIG. 4, showing a state of use.
Figure 9:
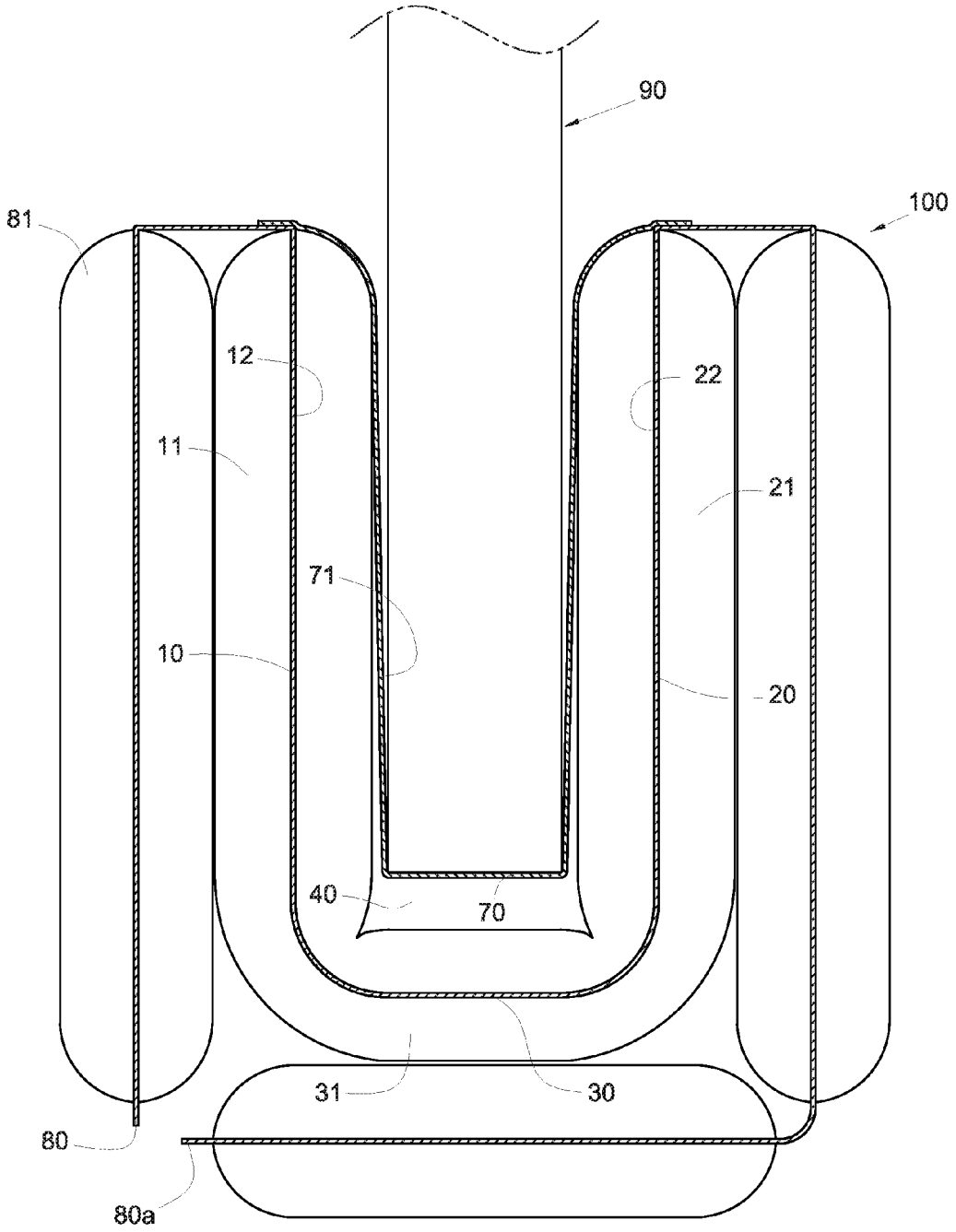
FIG. 9 is a sectional view similar to FIG. 8 but showing an additional embodiment.

The mode of implementation of the present invention is now described with reference to FIG. 1 to FIG. 8, wherein FIG. 1 is a front view of a preferred embodiment of the present invention; FIG. 2 is a side view of the embodiment shown in FIG. 1; FIG. 3 is a sectional view taken along line A-A of FIG. 1; FIG. 4 is a sectional view taken along line B-B of FIG. 1; FIG. 5 illustrates how the embodiment shown in FIG. 1 is used; FIG. 6 is a partial enlarged view of FIG. 5; FIG. 7 is a sectional view similar to FIG. 3, showing a state of use; FIG. 8 is a sectional view similar to FIG. 4, showing a state of use; and FIG. 9 is a sectional view similar to FIG. 8 but showing an additional embodiment.

The present invention provides a corner sleeve having a hammock-like cushioning structure. As shown in the drawings, the corner sleeve 100 includes a first air-column side 10, a second air-column side 20, and a bottom air-column side 30 connected between a bottom portion of the first air-column side 10 and a bottom portion of the second air-column side 20.

Each of the first air-column side 10, the second air-column side 20, and the bottom air-column side 30 is provided with a plurality of air columns 11, 21, 31, and a receiving space 40 is formed between the first air-column side 10, the second air-column side 20, and the bottom air-column side 30.

The inner surface of the first air-column side 10 and the inner surface of the second air-column side 20 are bonded together at a lateral end (hereinafter referred to as the first lateral end) by one or more fixedly connected portions 50, except in the vicinity of the bottom air-column side 30. Consequently, a triangular deformable opening 60 is formed at an end corner 101 of the corner sleeve 100 by an air column 11*a* of the first air-column side 10 at the first lateral end, an air column 21*a* of the second air-column side 20 at the first lateral end, and an air column 31*a* of the bottom air-column side 30 at the first lateral end. The deformable opening 60 corresponds in position to the unbonded parts of the inner surfaces of the first and the second air-column sides 10, 20 at the first lateral end.

The first-lateral-end air column 11*a* of the first air-column side 10, the first-lateral-end air column 21*a* of the second air-column side 20, and the first-lateral-end air column 31*a* of the bottom air-column side 30 surround the deformable opening 60 and define a triangular cushioning side 61 at the end corner 101 of the corner sleeve 100.

A hammock-like enclosing film 70 is provided in the receiving space 40, extends between the first air-column side 10 and the second air-column side 20, and stays clear of the bottom air-column side 30. The enclosing film 70 has a curved configuration that forms an accommodating space 71 on the inner side of the enclosing film 70.

More specifically, the present invention has the following technical features:

A lateral opening 41 is formed between the first air-column side 10 and the second air-column side 20 at the opposite lateral end (hereinafter referred to as the second lateral end). The lateral opening 41 is in communication with the receiving space 40 and with the accommodating space 71 on the inner side of the enclosing film 70. Moreover, an upper opening 42 is formed between a top portion of the first air-column side 10 and a top portion of the second air-column side 20 and is in communication with the receiving space 40, the accommodating space 71 on the inner side of the enclosing film 70, and the lateral opening 41.

Through the lateral opening 41 and the upper opening 42, an object to be packed 90 can be put into the receiving space 40 and the accommodating space 71 of the enclosing film 70 so that not only is the object 90 wrapped between the first air-column side 10, the second air-column side 20, the bottom air-column side 30, and the cushioning side 61, but also the object 90 is wrapped in the enclosing film 70 and thus supported or held in the receiving space 40 without contact with the bottom air-column side 30. In this embodiment, the object 90 may be a fragile object such as an LCD TV.

The fixedly connected portion 50 does not extend to the bottom air-column side 30, thus allowing a predetermined non-heat seal distance h1 to be formed between the bottom end of the fixedly connected portion 50 and the bottom air-column side 30. And because of this predetermined distance h1, the end corner 101 of the corner sleeve 100 forms the triangular deformable opening 60.

The air columns 11, 11*a* of the first air-column side 10 may extend to the top portion and the bottom portion of the first air-column side 10. The air columns 21, 21*a* of the second air-column side 20 may extend to the top portion and the bottom portion of the second air-column side 20. The air columns 31, 31*a* of the bottom air-column side 30 may extend to the two opposite middle sides of the bottom air-column side 30.

The first-lateral-end air column 11*a* of the first air-column side 10 and the first-lateral-end air column 21*a* of the second air-column side 20 are respectively in communication with the two opposite ends of the first-lateral-end air column 31*a* of the bottom air-column side 30. Meanwhile, plural air columns 11 of the first air-column side 10 and plural air columns of the second air-column side 20 are respectively in communication with the two opposite ends of a single air column of the bottom air-column side 30. As a result, the first-lateral-end air column 30 and the air columns 31 of the bottom air-column side 30 are different in size, which lends enhanced deformability and an increased cushioning ability to the air columns 31, 31*a* as a whole.

The fixedly connected portion 50 may be heat-sealed points or heat-sealed lines.

The fixedly connected portion 50 is formed by heat seating to heat seal the air column 11*a* of the first air-column side 10 and the air column 21*a* of the second air-column side 20, thus reducing the inflated volumes of the air columns 11*a*, 21*a*. The air columns 11*a*, 21*a* being heat sealed by the fixedly connected portions 50 are defined as fixedly connected air columns. When viewed from the side, therefore, referring to FIG. 2, the cushioning side 61, the first-lateral-end air columns 11*a*, 21*a*, 31*a*, and the air columns 11, 21, 31 are in a stacked configuration and have different outer sizes, which also contributes to enhanced deformability and effective cushioning.

Between a first-lateral-end edge 101*a* of the first air-column side 10 and the fixedly connected portion 50 is at least one air column 11*b* free of the fixedly connected portion 50. Similarly, at least one air column 21*b* free of the fixedly connected portion 50 is provided between the first-lateral-end edge 101*a* of the second air-column side 20 and the fixedly connected portion 50. The first-lateral-end edge 101*a* terminates the first lateral end. The air columns 11*b* and 21*b* free of any said fixedly connected portion 50 are defined as non-fixedly connected air columns. The air columns 11*b*, 21*b* (the non-fixedly connected air columns) free of the fixedly connected portion 50 are greater in volume than the air columns 11*a*, 21*a* (the fixedly connected air columns) formed with the fixedly connected portion 50. The air columns 11*b*, 21*b* without the fixedly connected portion 50 and the air columns 11*a*, 21*a* with the fixedly connected portion 50 add to the elasticity of the end corner 101 of the corner sleeve 100 and further increase the deformability and cushioning ability of the end corner 101.

The enclosing film 70 has two ends respectively provided on the inner surface 12 of the top portion of the first air-column side 10 and the inner surface 22 of the top portion of the second air-column side 20. Moreover, the enclosing film 70 extends to a position adjacent to the bottom air-column side 30. Thus, the enclosing film 70 resembles a hammock in form.

The present invention can be implemented with the components described above. Once the first air-column side 10, the second air-column side 20, and the bottom air-column side 30 of each of four corner sleeves 100, 100*a*, 100*b*, 100*c* are mounted around one of the end corners 91 of the object to be packed 90, the deformable opening 61 and the cushioning side 61 of each corner sleeve 100, 100*a*, 100*b*, 100*c* are located at the corresponding end corner 91 of the object 90, so as for the cushioning sides 61 to cover, and provide cushioning for, the end corners 91 of the object 90 respectively.

It should be pointed out that each end corner 91 of the object 90 is wrapped in the accommodating space 71 of the corresponding enclosing film 70 and is thus suspended or otherwise held in the corresponding receiving space 40, without any contact with the corresponding bottom air-column side 30. Consequently, a cushioning distance h2 is formed between each end corner 91 of the object 90 and the corresponding bottom air-column side 30. The air columns 31, 31*a* and the cushioning distance h2 provide a double cushioning effect.

The deformable opening 60 at the end corner 101 of each corner sleeve 100, 100*a*, 100*b*, 100*c* is so designed that the bottom ends of the first-lateral-end air columns 11*a*, 21*a*, 31*a* of the first, the second, and the bottom air-column sides 10, 20, 30 need not be connected to one another. This allows the air columns 11*a*, 21*a*, 31*a* to curve rather than bend sharply at the end corner 101, thereby preventing the air columns 11*a*, 21*a*, 31*a* from breaking. Also, the cushioning side 61 at the end corner 101 of each corner sleeve 100, 100*a*, 100*b*, 100*c* is so designed that, after the corner sleeves 100, 100*a*, 100*b*, 100*c* are respectively mounted around the end corners 91 of the object 90, the deformable opening 60 and the cushioning side 61 of each corner sleeve are located outward of the corresponding end corner 91 of the object 90, so as for the cushioning side 61 at the end corner 101 of each corner sleeve 100, 100*a*, 100*b*, 100*c* to provide anti-impact cushioning for the corresponding end corner 91 of the object 90.

Further, with the hammock-like enclosing film 70 located in the receiving space 40 but not in contact with the bottom air-column side 30, each end corner 91 of the object 90 is wrapped between the inner walls of the corresponding enclosing film 70, supported or held in the corresponding receiving space 40, kept from direct contact with the corresponding bottom air-column side 30, and therefore protected from damage or scratch which may otherwise result from an external impact force transmitted directly from the corresponding bottom air-column side 30. Thus, the aforementioned problems of the conventional air column designs are solved, which are susceptibility to breakage at the bent portions, potential loss of the intended cushioning effect when punctured by a sharp end corner of the packed object, and possible failure to protect the packed object from an impact force generated by collision with the ground, for the impact force may act directly on the bottom of the packed object and thus damage the packed object.

FIG. 9 is a sectional view of an additional embodiment similar to that depicted in FIG. 8. As shown in FIG. 9, the top portion of the first air-column side 10 and/or the top portion of the second air-column side 20 is provided with at least one extension air-column side 80, wherein each extension air-column side 80 is provided with a plurality of air columns 81 and configured for wrapping around the corner sleeve 100. The extension air-column sides 80, 80*a* may have one or multiple sections.

The extension air-column sides 80, 80*a* can be wrapped around the first air-column side 10, the second air-column side 20, and the bottom air-column side 30 of the corner sleeve 100 for enhanced anti-impact cushioning.

What is claimed is:

1. A corner sleeve with a hammock-like cushioning structure, the corner sleeve comprising a first air-column side, a second air-column side, and a bottom air-column side connected between a bottom portion of the first air-column side and a bottom portion of the second air-column side, each said air-column side being provided with a plurality of air columns, there being a receiving space formed between the first air-column side, the second air-column side, and the bottom air-column side, the corner sleeve being characterized in that:

an inner surface of the first air-column side and an inner surface of the second air-column side are bonded together near a lateral end via one or more fixedly connected portions, except in a vicinity of the bottom air-column side, such that a deformable opening is formed at an end corner of the corner sleeve by the air columns of the first air-column side, the second air-column side, and the bottom air-column side at the lateral end and corresponds in position to unbonded parts of the inner surfaces of the first and the second air-column sides at the lateral end, wherein the air columns forming the deformable opening surround the deformable opening and define a cushioning side at the end corner of the corner sleeve; and a hammock-like enclosing film is provided in the receiving space and extends between the first air-column side and the second air-column side without contact with the bottom air-column side;

wherein the one or more fixedly connected portions are formed by heat sealing to heal seal one of the air columns of the first air-column side and one of the air columns of the second air-column side near the lateral end, the air columns of the first and the second air-column sides which are heat sealed by the one or more fixedly connected portions being defined as fixedly connected air columns, the lateral end being terminated with a first-lateral-end edge, wherein at least one air column of the first air-column side and at least one air column of the second air-column side lay between the first-lateral-end edge and the one or more fixedly connected portions and are free of any said fixedly connected portion and defined as non-fixedly connected air columns, the non-fixedly connected air columns at the lateral end are greater in volume than the fixedly connected air columns such that the non-fixedly connected air columns at the lateral end and the fixedly connected air columns provide enhanced elasticity to the end corner of the corner sleeve.

2. The corner sleeve of claim 1, wherein a lateral opening is formed between the first air-column side and the second air-column side at a lateral end opposite the lateral end with the deformable opening and is in communication with the receiving space and an accommodating space formed by the hammock-like enclosing film, and an upper opening is formed between a top portion of the first air-column side and a top portion of the second air-column side and is in communication with the receiving space, the accommodating space of the hammock-like enclosing film, and the lateral opening, thus allowing a to-be-packed object to be placed into the receiving space and the accommodating space of the hammock-like enclosing film through the lateral opening and the upper opening, so as for the to-be-packed object to be wrapped between the first air-column side, the second air-column side, the bottom air-column side, and the cushioning side while being wrapped in the hammock-like enclosing film and thus supported or held in the receiving space without contact with the bottom air-column side.

3. The corner sleeve of claim 1, wherein the one or more fixedly connected portions do not extend to the bottom air-column side such that a predetermined non-heat seal distance is formed between the one or more fixedly connected portions and the bottom air-column side and causes the end corner of the corner sleeve to form the deformable opening, which is triangular.

4. The corner sleeve of claim 1, wherein the air columns of the first air-column side extend from a top portion to the bottom portion of the first air-column side, the air columns of the second air-column side extend from a top portion to the bottom portion of the second air-column side, and the air columns of the bottom air-column side extend to two opposite middle sides of the bottom air-column side.

5. The corner sleeve of claim 4, wherein plural said air columns of the first air-column side and plural said air columns of the second air-column side are respectively in communication with two opposite ends of a single said air column of the bottom air-column side.

6. The corner sleeve of claim 1, wherein the one or more fixedly connected portions are heat-sealed points or heat-sealed lines.

7. The corner sleeve of claim 1, wherein the hammock-like enclosing film has two ends respectively connected at a top portion of the first air-column side and a top portion of the second air-column side and extends to a position adjacent to the bottom air-column side, and is therefore in the form of a hammock.

8. The corner sleeve of claim 1, wherein a top portion of the first air-column side and/or a top portion of the second air-column side is provided with at least one extension air-column side which can be wrapped around the corner sleeve, each said extension air-column side being provided with a plurality of air columns.

* * * * *